United States Patent [19]

Rovida

[11] 4,455,697

[45] Jun. 26, 1984

[54] FOLDABLE CRIB OR PLAYPEN OF REDUCED ENCUMBRANCE

[76] Inventor: Ettore Rovida, Via Lupi di Toscana 10, Salo' (Brescia), Italy

[21] Appl. No.: 428,211

[22] Filed: Sep. 29, 1982

[51] Int. Cl.[3] ..... A47D 7/00

[52] U.S. Cl. ..... 5/99 C; 5/99 R; 256/25

[58] Field of Search ..... 256/25, 26; 5/99 A, 5/99 C, 99 B, 99 R

[56] References Cited

U.S. PATENT DOCUMENTS

| | | | |
|---|---|---|---|
| 2,908,021 | 10/1959 | Fulton | 5/99 R |
| 2,922,169 | 1/1960 | Werner | 5/99 R |
| 3,158,876 | 1/1964 | Gottlieb | 5/99 R |
| 4,070,716 | 1/1978 | Satt et al. | 5/99 C |

*Primary Examiner*—Andrew V. Kundrat
*Attorney, Agent, or Firm*—McGlew and Tuttle

[57] ABSTRACT

A foldable baby crib or playpen comprises two pairs of legs pivotally connected to each other by a pair of stirrups and two pairs of lower frame members pivotally connected to each other near a center of the crib or playpen. A pair of planar supports are connected to the pair of lower frame members so that the crib or playpen can be moved from an extended open position to a folded closed position with the pairs of legs extending substantially parallel to each other. Two pairs of rods are pivotally connected to opposite ends of the stirrups and extend outwardly from the stirrups. A pair of U-shaped elements have ends that are telescopically engaged with the two pairs of rods. The rods and U-shaped elements are connected by a train of tie rods and levers so that the rods are movable from an extended open position to a folded closed position lying substantially parallel to the two pairs of legs with the tie rod and the lever chain retracting the telescopically engaged U-shaped elements into the rods. The rods, tie rod and lever chain and U-shaped elements are covered by a protective member made of net-like or cloth-like material to form a hand rail.

6 Claims, 4 Drawing Figures

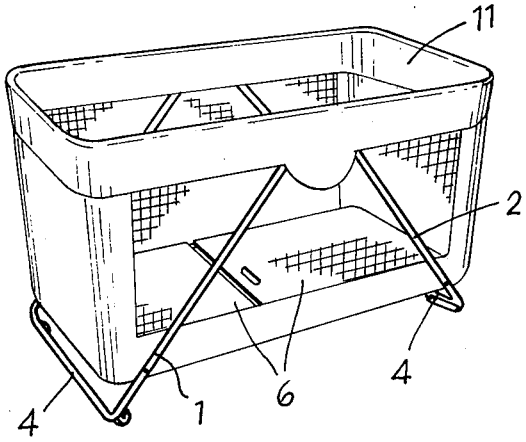
Fig. 1
Fig. 2
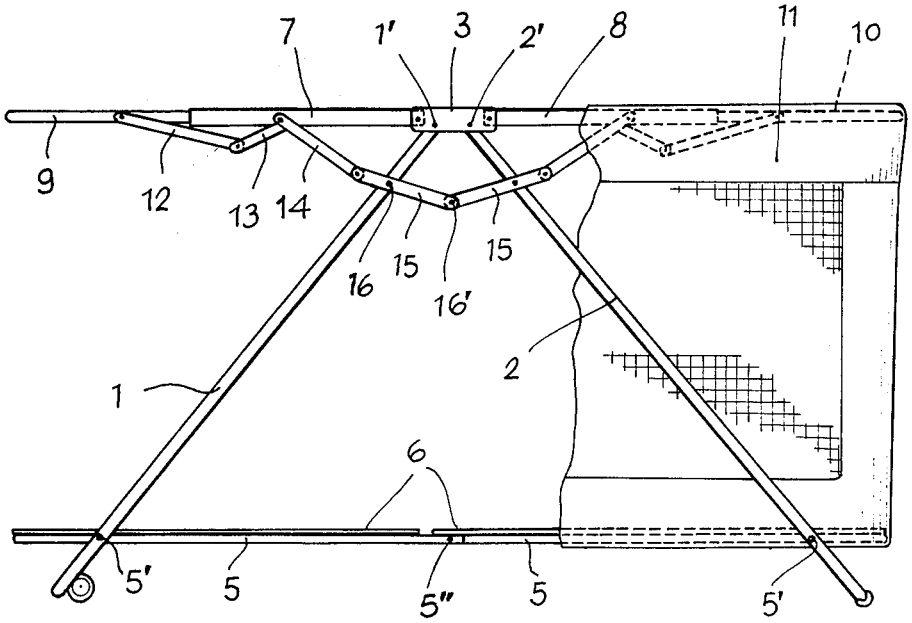

FOLDABLE CRIB OR PLAYPEN OF REDUCED ENCUMBRANCE

BACKGROUND OF THE INVENTION

The present invention relates to a child's article of furniture such as a bed, crib or playpen with elements which may be approached to one another in order to reduce the encumbrance of this type of furniture, to facilitate its packing and transportation and to enable it to occupy a more limited space when it is stored away and not in use.

Known already are beds, cribs, and playpens for infants and children and especially those having a base or floor member connected to the supporting legs by means of articulated rods in such a manner that the floor and the legs can be approached to one another when the upper hand-rail frame is folded.

However, the known and presently employed types of crib or playpen construction do not permit a satisfactory and effective reduction in the encumbrance of the article when this has been folded, because the supporting legs tend to retain some degree of spreading and, thus, occupy a space that affects negatively the operation of packing and transporting the crib or playpen.

Furthermore, in the known construction, some of the joints in the frame that carries the crib or playpen remain uncovered or unprotected so as to constitute a dangerous and hazardous element of the construction.

SUMMARY OF THE INVENTION

It is therefore an object of the present invention to provide a crib or playpen which is foldable and has structural, functional and safety features not heretofore available in the known types of construction and such as to permit an effective maximum reduction in volume, when folded, due to the possibility of a full approachment of the elements of the crib or playpen.

It is a further object of the invention to provide a crib or playpen in which the frame handrail and its respective joints or articulations remain permanently and completely enclosed within a protective, padded member, so as to eliminate all dangers of accidental injury to the user.

It is still another object of the invention to provide a crib or playpen having a frame hand rail that is extendible when the crib or playpen is in use, and conversely, retractable longitudinally when the crib or playpen is being folded, thus permitting the approachment of all the component parts of the crib or playpen without detaching, removing or affecting the padded, protective member of the structure.

BRIEF DESCRIPTION OF THE DRAWINGS

Greater structural details of the crib or playpen of the invention will become readily apparent from the following detailed description of the embodiments thereof and from the accompanying drawings which are merely illustrative of the invention but not limitative thereof, and in which:

FIG. 1 is a perspective view of the crib or playpen of the invention in condition of use;

FIG. 2 is a side elevational partial view of the crib or playpen;

DETAILED DESCRIPTION OF THE INVENTION

Figure 3:
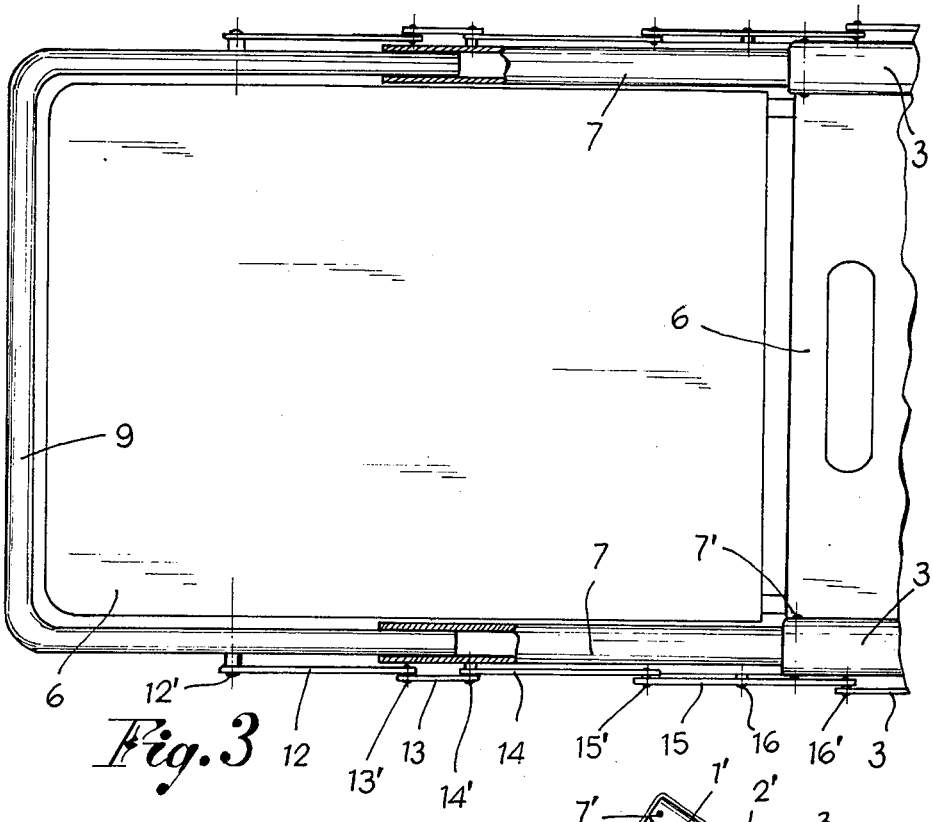
FIG. 3 is top view thereof.

Referring to the accompanying drawings, the crib or playpen of the invention comprises two pairs of legs 1, 2 pivotable, respectively, at 1' and 2' where they are connected to intermediate stirrups 3, so as to be spread as illustrated when the crib or playpen is in use and to become parallel and approached to each other when the crib or playpen is folded and not in use. Each pair of legs 1,2 consists preferably and advantageously of a U-shaped element so that the legs of each part be interconnected through a lower transverse member 4 provided with suitable feet or rollers or casters.

In the lower portion of the legs 1, 2 there are connected, pivotably at 5' two lower frame members 5 which are convergent in the center at which point 5'' they are connected to each other. To the frame member 5 there are attached two corresponding supports 6 which, when positioned horizontally and co-planarly, keep the two pairs of legs 1, 2 spread apart and form a single plane or surface for supporting the mattress or similar item.

To the two intermediate stirrups 3 there also are attached at 7' and, respectively, at 8', two pairs of rods 7,8 which extend in opposite directions and can be displaced from a horizontal position, when the crib is in use, to a substantially vertical downward position, approaching the legs 1,2 when the crib is folded. The extremities of each pair of rods 7,8 are connected by U-shaped elements 9,10 respectively, the ends of which are telescopically retractable within the rods 7,8. Rods 7,8 as well as their respective U-shaped elements 9,10 form together the upper hand rail of the frame and serve to support the protective member 11 of the crib or playpen. Said member 11 being generally net-like or reticular or cloth-like. The U-shaped elements 9,10 may be displaced with respect to the rods 7,8 so that the hand-rail might be extendible and contractible automatically in such a manner that the protective member 11 is correctly positioned and affords the proper tension, when the crib is in use.

To this effect, on each side of each U-shaped element 9,10 there is attached, pivotably at 12' one extremity of a tie-rod 12, the opposite extremity of which is instead pivotably connected at 13' to an arm 13 of an L-shaped lever 14. The apex of lever 14 is pivotably connected at 14' to the rod 7 (or 8) within which is guided telescopically the U-shaped element 9 (or 10). To the L-shaped lever 14 there is also pivotably connected at 15' a weight lever 15 which is connected at 16 to a leg and at 16' to lever 15 of the system of levers that originates at the opposite U-shaped element.

Due to the above described construction, the protective member 11, net-like or cloth-like constructed, may be installed in a permanent manner along the entire length of the hand rail, so as to enclose completely the rail as well as the system of levers and joints, as illustratively shown in FIG. 1 of the accompanying drawings. The protective member 11, at least in the portion thereof corresponding to the hand rail, may also be padded, in order to form a bumper-like protection and afford additional safety to the young crib user.

In any event, as stated hereinbefore, the extendibility of the U-shaped elements 9,10 with respect to the rods 7,8 allows a rapid and easy setup of the crib or playpen, as well as the folding thereof without removing or affecting the protective member 11.

To use the crib or playpen it is sufficient to displace the rods 7,8 and their respective, U-shaped elements 9,10 and to place them in the horizontal position. To such a displacement correspond, through the combination or system of tie-rods and levers, the spreading of the two pairs of legs 1,2 for the correct and proper support of the crib, the horizontal positioning of the mattress supports 6 and the extension of the U-shaped elements 9,10 from the rods 7,8 for the correct positioning of the protective member 11.

Figure 4:
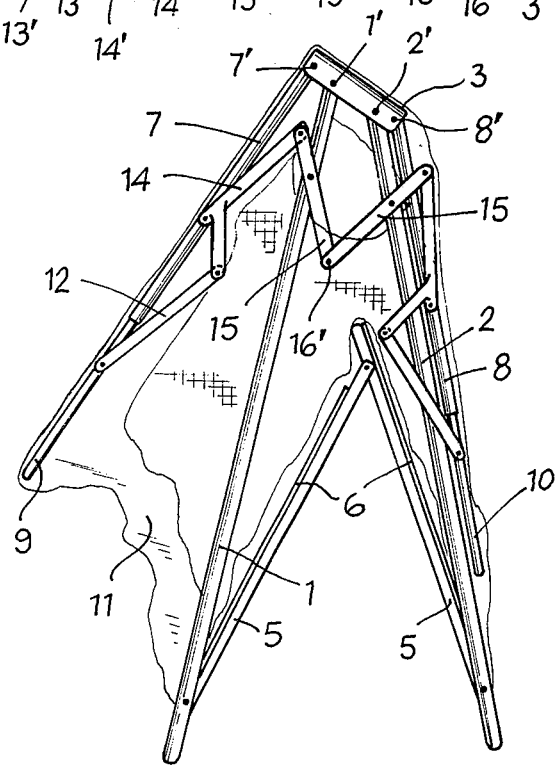
FIG. 4 shows an intermediate folding phase of the crib or playpen.

To fold the crib or playpen it suffices instead to act on one of the mattress supports 6 so as to displace the upwardly and to determine the approachment of the legs to one another and, by means of the system of tie-rods and levers, to determine the capsizing downwardly of the rods 7,8 concurrently to a displacement of the U-shaped elements 9,10 for the contraction of the hand rail, as shown in FIG. 4 of the accompanying drawings.

What is claimed is:

1. A foldable crib comprising:

two pairs of legs;

a stirrup pivotally connected to each pair of legs for displacement of each pair of legs from a spread position to a substantially parallel folded position;

two pairs of lower frame member, each member in each pair extending toward each other member in each pair and pivotally connected thereto for displacement of said two pairs of lower frame members from a spread position to a folded position;

a pair of supports supported on said pair of lower frame members, said pair of supports displaceable from a co-planar spread position to a folded position;

two pairs of rods pivotally connected to said stirrups and extending in opposite directions from said stirrups in a spread position thereof, said rods being displaceable into a folded position;

a pair of U-shaped elements each having ends telescopically engaged with one rod of each pair of rods; and articulating means connected between said pair of U-shaped elements and said two pairs of rods for telescopically retracting said pair of U-shaped elements with respect to said pair of rods with said pair of rods in their folded position.

2. A foldable crib according to claim 1, wherein said articulating means comprises a tie-rod pivotally connected at opposite sides of each U-shaped element, an L-shaped lever having an apex pivotally connected to each rod in each pair of rods, said L-shaped lever having a first arm pivotally connected to each of said tie-rods respectively and a second arm, and an additional lever pivotally connected to each leg of each pair of legs having one end connected to said L-shaped lever second arm and an opposite end, each opposite end of said additional levers on one side of said crib pivotally connected to each other.

3. A foldable crib according to claim 2, wherein each pair of legs includes a cross-member connecting each pair of legs together.

4. A foldable crib according to claim 1, wherein said pair of U-shaped elements and said two pairs of rods comprise a hand rail, said foldable crib including a protective member overlying said hand rail and said articulating means.

5. A foldable crib according to claim 4, wherein said protective member is made of net-like and cloth-like material.

6. A foldable crib according to claim 4, wherein said articulating means comprises a tie-rod pivotally connected at opposite sides of each U-shaped element, an L-shaped lever having an apex pivotally connected to each rod in each pair of rods, said L-shaped lever having a first arm pivotally connected to each of said tie-rods respectively and a second arm, and an additional lever pivotally connected to each leg of each pair of legs having one end connected to said L-shaped lever second arm and an opposite end, each opposite end of said additional levers on one side of said crib pivotally connected to each other.

* * * * *